US009052077B2

(12) United States Patent
Chien

(10) Patent No.: US 9,052,077 B2
(45) Date of Patent: Jun. 9, 2015

(54) LED LAVA LIGHT

(76) Inventor: Tseng-Lu Chien, Walnut, CA (US)

( * ) Notice: Subject to any disclaimer, the term of this patent is extended or adjusted under 35 U.S.C. 154(b) by 355 days.

(21) Appl. No.: 12/938,798

(22) Filed: Nov. 3, 2010

(65) Prior Publication Data

US 2012/0106132 A1 May 3, 2012

(51) Int. Cl.

| | |
|---|---|
| ***F21V 33/00*** | (2006.01) |
| ***F21S 10/00*** | (2006.01) |
| ***F21S 8/00*** | (2006.01) |
| ***F21S 9/02*** | (2006.01) |
| *F21W 121/00* | (2006.01) |
| *F21Y 101/02* | (2006.01) |

(52) U.S. Cl.

CPC ..... *F21S 10/002* (2013.01); *F21S 8/035* (2013.01); *F21S 9/02* (2013.01); *F21W 2121/00* (2013.01); *F21Y 2101/02* (2013.01)

(58) Field of Classification Search

CPC ..... F21S 10/002; F21S 8/035; F21S 9/02; G09F 13/24; F21V 9/12; F21V 33/00; F21Y 2101/02; F21W 2121/00

USPC ..... 362/101, 640–664; 40/406, 407

See application file for complete search history.

(56) References Cited

U.S. PATENT DOCUMENTS

| | | | | |
|---|---|---|---|---|
| 4,072,855 | A * | 2/1978 | Marchese | 362/101 |
| 5,416,994 | A * | 5/1995 | McLaughlin | 40/406 |
| 5,575,553 | A * | 11/1996 | Tipton | 362/101 |
| 5,678,918 | A * | 10/1997 | Lin | 362/96 |
| 6,517,231 | B1 * | 2/2003 | Biardeau et al. | 366/273 |
| 6,877,883 | B2 * | 4/2005 | Lau Ting Yup et al. | 362/363 |
| 7,186,016 | B2 * | 3/2007 | Jao | 362/644 |
| 7,905,728 | B2 * | 3/2011 | Piontek | 434/276 |
| 7,909,477 | B2 * | 3/2011 | Chien | 362/101 |
| 8,434,927 | B2 * | 5/2013 | Chien | 362/641 |
| 8,695,247 | B1 * | 4/2014 | Yang | 40/442 |
| 2005/0201081 | A1 * | 9/2005 | Brady | 362/101 |
| 2006/0007709 | A1 * | 1/2006 | Yuen | 362/641 |
| 2006/0215397 | A1 * | 9/2006 | Lee | 362/161 |
| 2009/0135586 | A1 * | 5/2009 | Yang | 362/101 |
| 2009/0175033 | A1 * | 7/2009 | Chien | 362/183 |
| 2011/0119971 | A1 * | 5/2011 | Chen | 40/406 |

* cited by examiner

*Primary Examiner* — Thomas M Sember
(74) *Attorney, Agent, or Firm* — Bacon & Thomas, PLLC

(57) ABSTRACT

An LED lava light includes a motor, propeller, first magnetic element(s), second magnetic element(s), a freely movable base, LED(s), circuitry, and a controller, timer, sensor, trigger, and conductors to cause the propeller to rotate and liquid to flow, thereby causing inside miniature stuff to change position and provide splendid light effects. Toxic liquid and a heater are eliminated for greatly increased safety and reduced fire hazard.

2 Claims, 4 Drawing Sheets

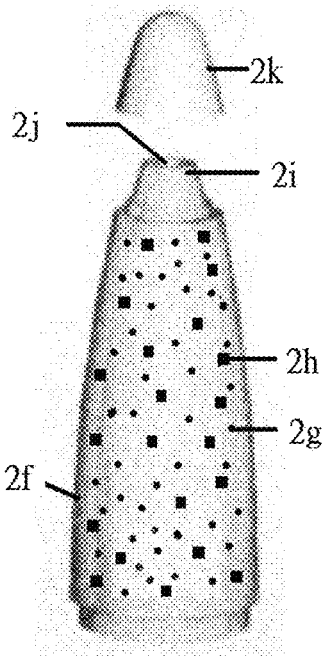
Fig 2
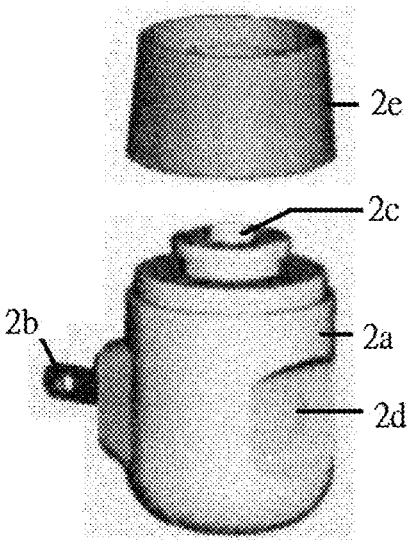

LED LAVA LIGHT

BACKGROUND OF THE INVENTION

This application has subject matter in common with the inventor's prior U.S. patent application Ser. Nos. 12/624,621, 12/622,100, 12/318,471, 12/318,470, 12/318,473, 12/292,153, 12/232,505, 12/232,035, 12/149,963, 12/149,964, 12/073,095, 12/073,889, 12/007,076, 12/003,691, 12/003,809, 11/806,711, 11/806,285, 11/806,284, 11/566,322, 11/527,628, 11/527,629, 11/498,874, 12/545,992, 12/806,711, 12/806,285, 12/806,284, 12/566,322, 12/527,628, 12/527,629, 12/527,631, 12/502,661, 11/498,881, 11/255,981, 11/184,771, 11/152,063, 11/094,215, 11/092,742, 11/092,741, 11/094,156, 11/094,155, 10/954,189, 10/902,123, 10/883,719, 10/883,747, 10/341,519, 12/545,992, 12/292,580, 12/710,918, 12/622,000, 12/710,561, 12/710,918, 12/711,456, and Ser. No. 12/771,003.

The above-listed prior patent applications of the inventor describe LED lights for outdoor or indoor application. Like the present invention, the LED lights described in the prior applications may be powered by alternating current (AC) or direct current (DC) supplied by an electric cord and plug, battery, transformer, solar cell, or other power source, and apply physics or optics theory to create a plurality of LED light beam to illuminate close area(s) or remote area(s) using projection means in combination with any other features described in the inventor's prior applications, including use of more than one light source, more than one function, more than one optics means, and/or more than one projection means with super power saving circuitry and cost saving concepts.

SUMMARY OF THE INVENTION

The current invention relates to an LED lava light which has no toxic liquid material within the compartment. It also does not have a heater means, eliminating a big fire hazard that could otherwise result from overheating of the heater means.

The LED lava light of the current invention uses a timer motor incorporated with magnetic means to rotate a propeller and cause liquid to flow, and inner miniatures to move, to provide splendid motion effects during illumination.

The current invention overcomes disadvantages of conventional lava lights, such as (1) toxicity of the liquid, and (2) heat hazard.

BRIEF DESCRIPTION OF THE DRAWINGS

FIG. 2 shows the detailed construction of the first preferred embodiment, including a top cover, liquid container, light passing piece, LED, base, sensor means, prong means and inner circuit means. The liquid container may have a variety of miniature stuff designs, including round pieces, rectangular pieces, star shapes, heart shapes, and/or cartoon characters. The light passing pieces can be transparent or translucent based on market requirements. The number of LEDs can be any number from one to N to provide a desired light performance.

FIG. 4-1 shows a battery-powered LED lava light which has at least moving miniature stuff and a built-in night light, the motor means incorporating magnetic means.

FIG. 4-2 shows an AC-powered LED lava light which has at least moving miniature stuff and a built-in night light, the motor means incorporating magnetic means.

FIG. 4-3 shows the detailed construction of an AC-powered LED lava light which has more than one LED to enable the lava light has more than to emit light beams in different directions.

DETAIL DESCRIPTION OF THE PREFERRED EMBODIMENTS

Figure 1:
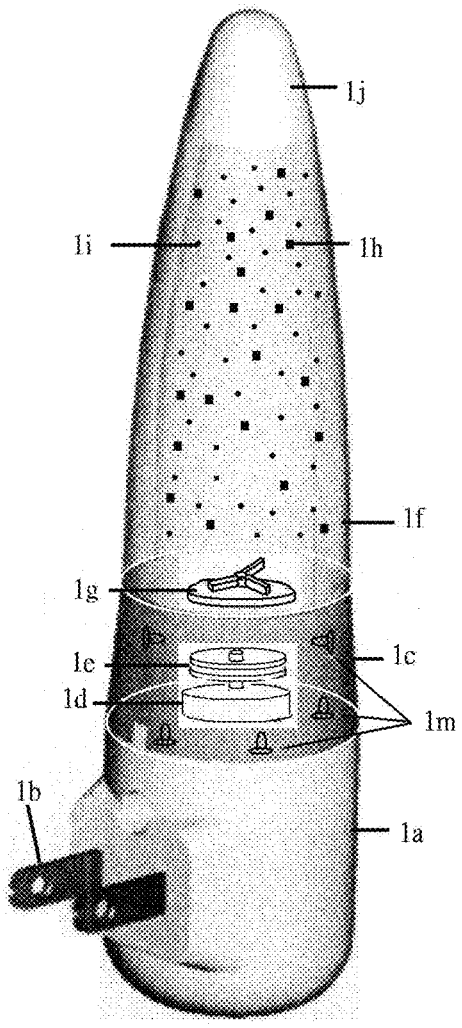
FIG. 1 shows a first preferred embodiment in which a liquid container has a propeller and magnetic means to cause liquid to flow and inside miniature stuff to move, a timer motor having magnetic means that interacts with the propeller's magnetic means to rotate the propeller and make the fluid flow for a certain period of time. Built-in LED(s) and circuit means cause the said LED to emit light according to a predetermined function, color, and brightness.

FIG. 1 shows a first preferred embodiment including a top cover (1*j*), a base (1*a*) from which extend prongs (1*b*), and a liquid container (1*f*) having a propeller (1*g*) and first magnetic means (not shown) to cause liquid to flow and inside miniature stuff (1*h*) (1*i*) to move. A light passing piece 1*c* encloses parts of a timer motor 1*d* having a second magnetic means (1*e*) to interact with the propeller's first magnetic means and thereby cause rotation of the propeller to make the fluid flow for certain period of time. Built-in LED(s) 1*m* and circuit means (not shown) cause the LED(s) 1*m* to emit light according to pre-determined functions, color, and/or brightness.

Figures 1, 4:
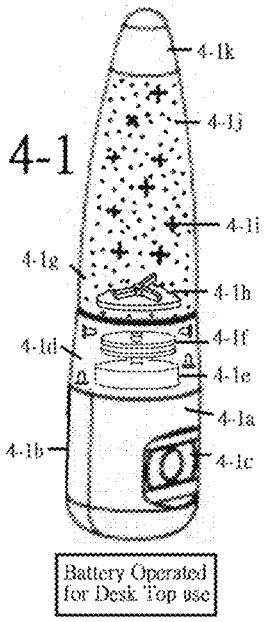
Figures 2, 4:
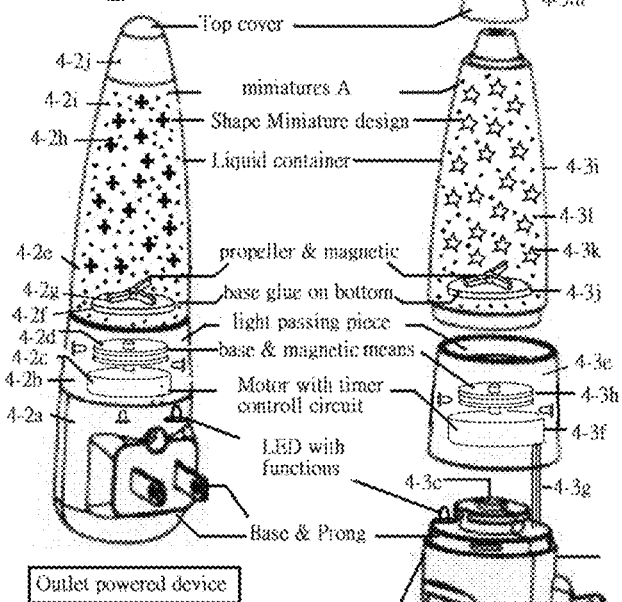
Figures 3, 4:
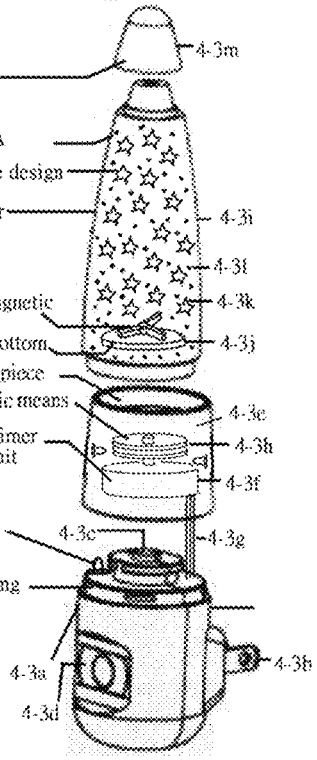

FIG. 2 shows the detailed construction of the first preferred embodiment, including top cover (2*k*), which fits over cap (2*i*) and is secured to a post (2*j*) extending from liquid container (2*g*), light-passing piece (2*e*), LED(s) (not shown), base (2*a*), light passing piece (2*e*) into which extends motor (2*c*), sensor means (2*d*), prong means (2*b*) and inner circuit means (not shown). The liquid container (2*f*) contains miniature stuff (2*g*) (2*h*) having any of a variety of designs, such as round pieces (2*g*), rectangular pieces (2*h*), star shapes, heart shapes, and/or cartoon characters. The light passing piece (2*e*) can be transparent or translucent depending on market requirements. The LED number can be any number (one to N) to provide a desired light performance.

Figure 3:
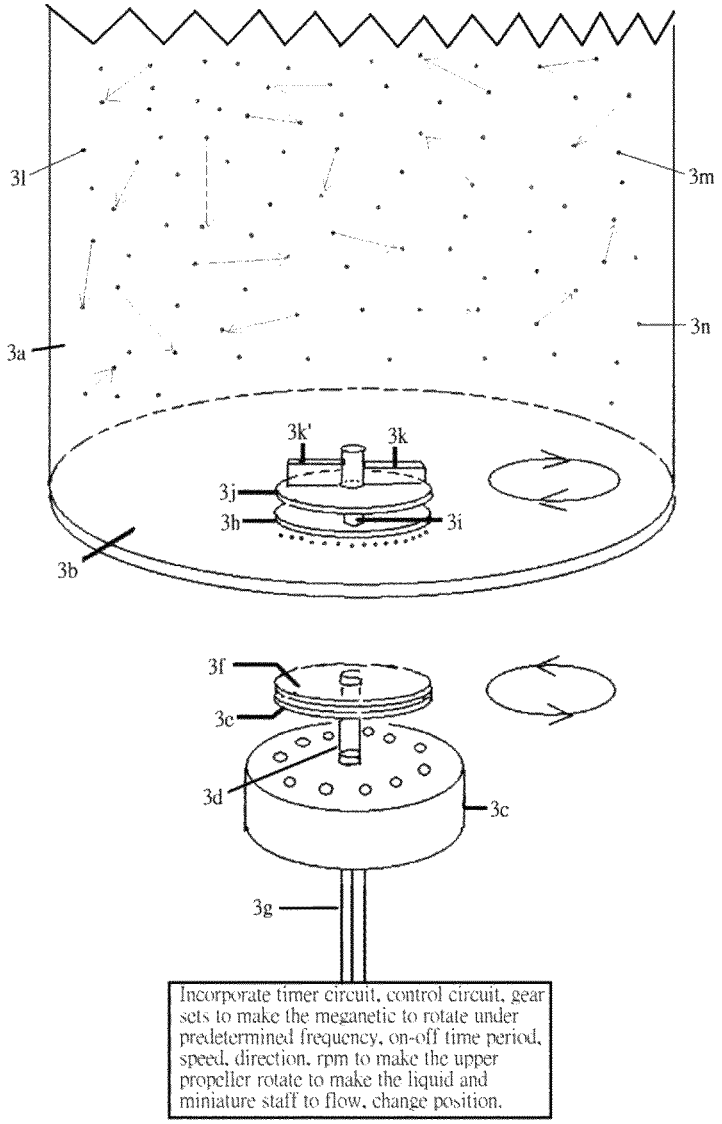
FIG. 3 shows a propeller and magnetic piece having a base which is glued on the bottom of liquid container. The propeller and magnetic piece interact with a motor having its own magnetic piece and installed on the outside of the liquid container. The motor incorporates control means to provide a certain speed and rotating time and duration so as to cause the inner miniatures to move at a desired speed and generate eye catching motion effects of the miniature stuff.

FIG. 3 shows a propeller (3*k*) (3*k'*) and first magnetic means (3*j*) having a base (3*h*) which is glued on the bottom (3*b*) of the liquid container (3*a*). The propeller (3*k*) (3*k'*) and first magnetic means (3*j*) interact with the motor (3*c*) and second magnetic means (3*f*) installed on a disc (3*e*) and spindle 3*d* extending from the motor 3*c* at the outside of the liquid container (3*a*). The motor (3*c*) is connected by electrical connections (3*g*) to control means that control rotation of the propeller at a certain speed and for a certain rotating time and duration to cause the inner miniature staff (3*l*) (3*m*) (3*n*) to move at a speed suitable for generating eye catching motion effects of the miniatures stuff (3*l*) (3*m*) (3*n*).

FIG. 4-1 shows a battery-powered LED lava light (4-1*b*) including a base (4-1*a*), cap (4-1*k*), sensor (4-1*c*), light-passing piece (4-1*d*), liquid container (4-1*g*) containing a liquid and moving miniature stuff (4-1*i*) (4-1*j*), a variety of LEDs, and motor means (4-1*e*) incorporated with second magnetic means (4-1*f*). The motor means (4-1*e*) drives the second magnetic means (4-1*f*) to activate the first magnetic means and propeller (4-1*h*), causing the liquid to move and thereby cause all miniature stuff (4-1*i*) (4-1*j*) to also move. The miniature stuff can be reflective pieces that reflect all incoming LED light beams in a variety of directions to provide eye-catching effects.

FIG. 4-2 shows an AC-powered LED lava light (4-2*a*) which also includes a top cover (4-2*j*), light-passing piece (4-2*b*), moving miniature stuff (4-*i*) (4-2*h*), and motor means (4-2*c*) incorporated with second magnetic means (4-2*d*) to drive an upper first magnetic means and propeller (4-2*g*) situated on propeller base (4-2*f*) to rotate, causing the miniature stuff to move and reflect all incoming LED light beams in all directions.

FIG. 4-3 shows details of the AC-powered LED lava light (4-3*i*) which has more than one LED (such as four LEDs) in a light-passing piece (4-3*e*) to cause the lava light emit light beams in different directions. The LED lava light (4-3*i*) of this embodiment includes a top cover (4-3*m*), moving miniature stuff (4-3*k*) (4-3*l*), propeller base and propeller (4-3*j*) with first magnetic means, disc (4-3*h*) with second magnetic means, motor (4-3*f*), electrical connections (4-3*g*) to a controller in base (4-3*a*), motor support (4-3*c*), sensor (4-3*d*), and prongs (4-3*b*). As shown in FIG. 4-3, the liquid container shown in FIG. 4-2, which includes miniature stuff in the form of plus signs, has been interchanged with a liquid container containing miniature stuff (4-3*k*) (4-3*l*) that includes stars.

The invention claimed is:

1. An LED lava light, comprising:

at least one liquid container filled with a liquid and a plurality of miniature objects having colorful or reflective properties;

at least one propeller rotatably mounted within said liquid container, said propeller being caused to rotate by interaction between a first magnetic means on said propeller and a second magnetic means driven by a motor mounted on a base;

means for controlling said motor to rotate at a predetermined speed and cause said propeller to rotate by interaction between said first magnetic means and said second magnetic means, rotation of said propeller causing movement of said liquid, and movement of said liquid causing movement of said miniature objects;

at least a first LED for emitting light through said liquid container for illumination of said moving objects;

at least a second LED for emitting light in a direction that is different from a light emission direction of said first LED; and a power supply means for supplying electricity to said motor and said first and second LEDs, said power supply means selected from the group consisting of a prong means for connection to an electrical outlet, at least one battery, an adaptor, a transformer, an energy storage device, and a connection to a solar, wind, or chemical power source, wherein said first LED is mounted on the base and the second LED is mounted within a transparent or translucent piece extending between said base and said liquid container, wherein a direction of light emitted by the second LED is through said transparent or translucent piece to provide a night light function.

2. An LED lava light, comprising:

at least one LED; an LED base; a transparent or translucent piece attached to the LED base and surrounding said at least one LED such that light passing through the transparent or translucent piece provides a night light function;

a first liquid container containing a liquid and miniature objects within said liquid, said liquid container being connected to the transparent or translucent piece with the transparent or translucent piece extending between the first liquid container and the LED base; and a top cover on the liquid container;

a second liquid container containing a second liquid and different miniature objects within said second liquid, said second liquid container being interchangeable with the first liquid container by connecting said second liquid container to said transparent or translucent piece attached to the LED base;

a propeller situated in each said first and second liquid container and a motor mounted on the base, said propeller and motor including respective first magnetic means and second magnetic means for causing said motor to rotate said propeller by magnetic interaction between said first magnetic means and said second magnetic means, wherein said at least one LED and said motor are supplied with power by power-supplying components including electricity-carrying conductors, electrical circuitry, and a power source selected from the group consisting of prong means extending from said LED base for connection to an electrical outlet and energy storage components or batteries within said LED base, and further comprising a controller, and a timer, wherein said controller and said timer cause said motor to drive said propeller for a predetermined period of time to move said liquid and said miniature objects in a respective one of said first and second liquid containers while said at least one LED is illuminated.

* * * * *